US010460705B1

(12) United States Patent
Bitters

(10) Patent No.: US 10,460,705 B1
(45) Date of Patent: Oct. 29, 2019

(54) PICK GRIPPING SYSTEM

(71) Applicant: Kurt Bitters, Irvine, CA (US)

(72) Inventor: Kurt Bitters, Irvine, CA (US)

( * ) Notice: Subject to any disclaimer, the term of this patent is extended or adjusted under 35 U.S.C. 154(b) by 0 days.

(21) Appl. No.: 16/411,798

(22) Filed: May 14, 2019

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 4,150,601 A * 4/1979 Henley, Jr. ..... G10D 3/163 84/322
4,711,150 A * 12/1987 Hyduck ..... G10D 3/163 84/322
5,307,722 A * 5/1994 La Rosa ..... G10D 3/163 84/322
5,307,723 A * 5/1994 De La Rosa ..... G10D 3/163 84/322
5,587,542 A * 12/1996 Everly ..... G10D 3/163 84/322
5,648,622 A * 7/1997 Storey ..... G10D 3/163 84/322
7,067,729 B2 * 6/2006 Leong ..... G10D 3/163 84/320
D654,532 S 2/2012 Morales
9,202,446 B2 * 12/2015 Gauthier ..... G10D 3/163
9,240,167 B2 * 1/2016 Caccia ..... G10D 3/163
9,972,290 B1 * 5/2018 Mason ..... G10D 3/163
2005/0211053 A1 * 9/2005 Ball ..... G10D 3/163 84/322
2009/0139384 A1 * 6/2009 Bramucci ..... G10D 3/163 84/322
2015/0262562 A1 * 9/2015 Goble ..... G10D 3/163 84/322

OTHER PUBLICATIONS

Steve Clayton, Clayton Cork Grip, May 9, 2019, USA https://www.steveclayton.com/corkgrip.php.
Dava, Dava Grip Tips, May 9, 2019, USA https://www.davapick.com/picks/grip_tip.

* cited by examiner

*Primary Examiner* — Robert W Horn
(74) *Attorney, Agent, or Firm* — John D. Tran; Rhema Law Group

(57) ABSTRACT

A method and apparatus can include: a bottom surface formed on a body, the body having a left side, a right side, a proximal end, and a distal end; an intermediate surface formed on the body; and a top surface formed on the body, the top surface coupled to the intermediate surface with upward extending sides therebetween, the upward extending sides and the top surface forming a first lateral ridge extended from the left side of the body to the right side of the body, the upward extending sides and the top surface forming a second lateral ridge extended from the left side of the body to the right side of the body, the upward extending sides and the top surface forming a longitudinal ridge between the first lateral ridge and the second lateral ridge, and the first lateral ridge and the second lateral ridge forming a thumb recess therebetween.

20 Claims, 2 Drawing Sheets

PICK GRIPPING SYSTEM

TECHNICAL FIELD

This disclosure relates to instrumental picks, more particularly to a gripping system for a pick.

BACKGROUND

Instrumental picks have been ubiquitously used with stringed instruments throughout history. In modern times, picks have largely taken a flat triangular form with a wider proximal end tapering toward a narrower distal end for contact with the instrumental strings.

While the instrumental pick has been commonly used in its present form, there are many problems that arise with this design. For example, instrumental picks can be slippery.

Further, it can be difficult to keep the instrumental pick at a 90-degree angle between the direction of the thumb, and the longitudinal direction of the pick. Yet further, it can be difficult to keep the amount of the tip of the pick that is exposed consistent.

Previous designs attempt to reduce slippage by providing a rough textured surface at the center of where the thumb contacts the pick. Although textured surfaces may provide surface grip, they all but fail to provide any leverage or gripping edge. Also, textured surfaces largely fail to orient the pick properly or ensure the proper amount of exposed distal end.

Other previous designs have included thumb picks that wrap around the thumb. These thumb picks can solve the problem of positioning and grip but do so at the expense of usability since it is difficult to transition between a thumb pick and a finger-style method of plucking strings during different parts of a given song.

Solutions have been long sought but prior developments have not taught or suggested any complete solutions, and solutions to these problems have long eluded those skilled in the art. Thus, there remains a considerable need for a simple and cost effective solution providing proper orientation, proper positioning, and effective grip of an instrumental pick.

SUMMARY

A pick gripping system and methods of manufacture are disclosed for providing proper orientation, proper positioning, and effective grip of an instrumental pick. The pick gripping system and methods can include: a bottom surface formed on a body, the body having a left side, a right side, a proximal end, and a distal end; an intermediate surface formed on the body; and a top surface formed on the body, the top surface coupled to the intermediate surface with upward extending sides therebetween, the upward extending sides and the top surface forming a first lateral ridge extended from the left side of the body to the right side of the body, the upward extending sides and the top surface forming a second lateral ridge extended from the left side of the body to the right side of the body, the upward extending sides and the top surface forming a longitudinal ridge between the first lateral ridge and the second lateral ridge, and the first lateral ridge and the second lateral ridge forming a thumb recess therebetween.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The pick gripping system is illustrated in the figures of the accompanying drawings which are meant to be exemplary and not limiting, in which like reference numerals are intended to refer to like components, and in which.

DETAILED DESCRIPTION

Figure 1:
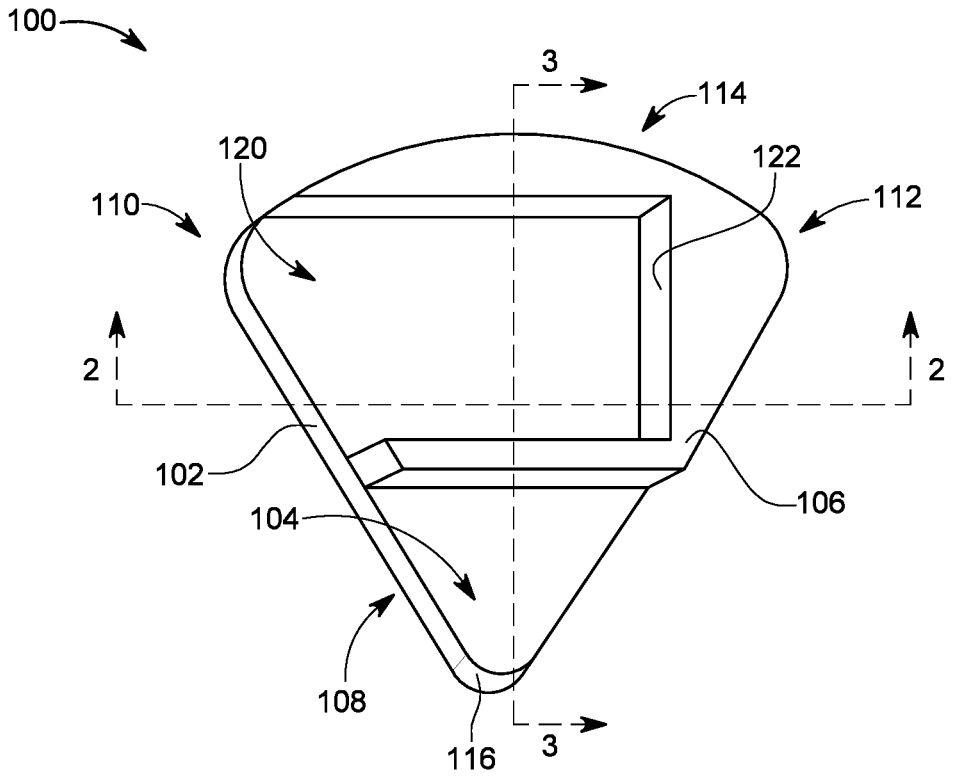
FIG. 1 is an isometric view of the pick gripping system.

In the following description, reference is made to the accompanying drawings that form a part hereof, and in which are shown by way of illustration, embodiments in which the pick gripping system may be practiced. It is to be understood that other embodiments may be utilized and structural changes may be made without departing from the scope of the pick gripping system.

When features, aspects, or embodiments of the pick gripping system are described in terms of steps of a process, an operation, a control flow, or a flow chart, it is to be understood that the steps can be combined, performed in a different order, deleted, or include additional steps without departing from the pick gripping system as described herein.

The pick gripping system is described in sufficient detail to enable those skilled in the art to make and use the pick gripping system and provide numerous specific details to give a thorough understanding of the pick gripping system; however, it will be apparent that the pick gripping system may be practiced without these specific details.

In order to avoid obscuring the pick gripping system, some well-known system configurations and descriptions are not disclosed in detail. Likewise, the drawings showing embodiments of the system are semi-diagrammatic and not to scale and, particularly, some of the dimensions are for the clarity of presentation and are shown greatly exaggerated in the drawing FIGs.

As used herein, the term system is defined as a device or method depending on the context in which it is used. For expository purposes, the term "horizontal" as used herein is defined as a plane parallel to the top plane or surface of the thumb recess, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane.

Referring now to FIG. 1, therein is shown an isometric view of the pick gripping system 100. The pick gripping system 100 is depicted having a body 102 with an intermediate surface 104 and a top surface 106, the top surface 106 extended away from the intermediate surface 104.

The body 102 is further shown having a bottom surface 108, a left side 110, a right side 112, a proximal end 114, and a distal end 116. The proximal end 114 can be the end gripped by a user and is depicted as flared out or enlarged to facilitate a better grip by a user.

The distal end 116 can be the end opposite the proximal end 114 and can be shaped and configured to pluck tensioned strings of musical instruments. The top surface 106 can extend away from the intermediate surface 104 of the body 102 as ridges. The top surface 106 can segment portions of the body 102 into distinct areas for specialized use.

For example, the top surface 106 can extend laterally across the body 102 from the right side 112 to the left side 110 and segmenting the distal end 116 from other portions of the body 102.

The top surface 106 does not extend over or into the distal end 116. It has been discovered that the distal end 116 can be reinforced by the addition of the top surface 106 extended into portions of the distal end 116, conversely, the distal end 116 can be made more pliant by eliminating the top surface 106 from the distal end 116, as is shown.

The top surface 106 can further extend up from the intermediate surface 104 along the right side 112 and the proximal end 114 for forming a thumb recess 120. The thumb recess 120 can provide a better grip and a surface for thumb placement. The top surface 106 extended up around three sides of the thumb recess 120 can further provide instant and intuitive alignment for musicians.

The intermediate surface 104 of the thumb recess 120 can be connected to the top surface 106 with upward extending sides 122 therebetween. The upward extending sides 122 can surround the thumb recess 120 on three sides.

The upward extending sides 122 are depicted as vertical sides but it is contemplated that the upward extending sides 122 can also extend upward in an angle acute or obtuse from the intermediate surface 104 of the thumb recess 120. The upward extending sides 122 together with the top surface 106 can provide enhanced grip for a musician and provide a consistent amount of distance between the center of the thumb recess 120 and the distal end 116.

One of the upward extending sides 122 is also depicted bordering the distal end 116. It has been discovered that the ridges created by the top surface 106 extended away from the intermediate surface 104 with the upward extending sides 122 therebetween, provides a non-slip grip with the upward extending sides 122 depicted at right-angles to each other and at right-angles to the intermediate surface 104.

The positioning of the thumb recess 120 with the top surface 106 forming ridges around the thumb recess 120 helps to ensure the body 102 is held or oriented at a 90-degree angle between the direction of the thumb, and the axis spanning from the proximal end 114 to the distal end 116. Proper orientation is ensured in part by the alignment and direction of the upward extending sides 122 and their transition to the top surface 106 around portions of the thumb recess 120.

Further, the position of the thumb recess 120 at a fixed location near the proximal end 114 ensures a proper positioning of the grip enabling a consistent amount or length of the distal end 116 being exposed from a user's grip. It has been discovered that the upward extending sides 122 together with the raised top surface 106 reduces slippage by providing a raised contact edge and surface for contacting the thumb of a user around the thumb recess 120.

The thumb recess 120 can be bordered on three sides by the upward extending sides 122; however, on the left side 110, the thumb recess 120 is not bordered by the upward extending sides 122. It has been discovered that providing the upward extending sides 122 only on three sides of the thumb recess 120 provides fast intuitive orientation and positioning of the body 102

The left side 110 of the body 102 is shown to have the intermediate surface 104 fully exposed and not covered by the top surface 106. It has been discovered that providing the left side 110 without the ridge formed by the top surface 106 extended therefrom allows a user's thumb to slide sideways for a more comfortable grip without losing orientation between the thumb and the pick gripping system 100 and without losing the positioning between the thumb and the distal end 116.

It has been discovered that the upward extending sides 122 terminating in the top surface 106 provide an intuitive feel providing instant orientation and positioning feedback to a user. The upward extending sides 122 terminating in the top surface 106 can form ridges, for example.

Illustratively, lateral ridges can be formed, traversing from the left side 110 to the right side 112 across the body 102. The lateral ridges can include a first lateral ridge 124 extended from the left side 110 to the right side 112 and across the proximal end 114.

The lateral ridges can further include a second lateral ridge 126 extended from the left side 110 to the right side 112 between the distal end 116 and the thumb recess 120. Further, longitudinal ridges can be formed by the upward extending sides 122 terminating in the top surface 106.

For example, the upward extending sides 122 terminating in the top surface 106 can form a longitudinal ridge 128. The longitudinal ridge 128 can extend along the distal end 116—proximal end 114 axis and along the right side 112 of the body 102 and the right side of the thumb recess 120.

The body 102 is depicted having a flat bottom surface 108, intermediate surface 104, and top surface 106, however it is contemplated that the bottom surface 108, the intermediate surface 104, the top surface 106, or a combination thereof could be curved without departing from the pick gripping system 100 as disclosed.

The top surface 106 forming the first lateral ridge 124, the second lateral ridge 126, and the longitudinal ridge 128 can be formed integrally with the body 102 or can be formed separately and later adhered through a thermal coupling between surfaces or with the use of an adhesive. In cases where the first lateral ridge 124, the second lateral ridge 126, and the longitudinal ridge 128 are formed independently of the body 102, it is further contemplated that the first lateral ridge 124, the second lateral ridge 126, and the longitudinal ridge 128 could be formed independently and later adhered or affixed to each other and to the body 102.

In cases where the first lateral ridge 124, the second lateral ridge 126, and the longitudinal ridge 128 are formed integrally with the body 102, the first lateral ridge 124, the second lateral ridge 126, and the longitudinal ridge 128 could be formed by etching or removing material from the top surface 106 down. Alternatively, the first lateral ridge 124, the second lateral ridge 126, and the longitudinal ridge 128 could be formed by the use of a mold defining the first lateral ridge 124, the second lateral ridge 126, and the longitudinal ridge 128 around the thumb recess 120.

Figure 2:
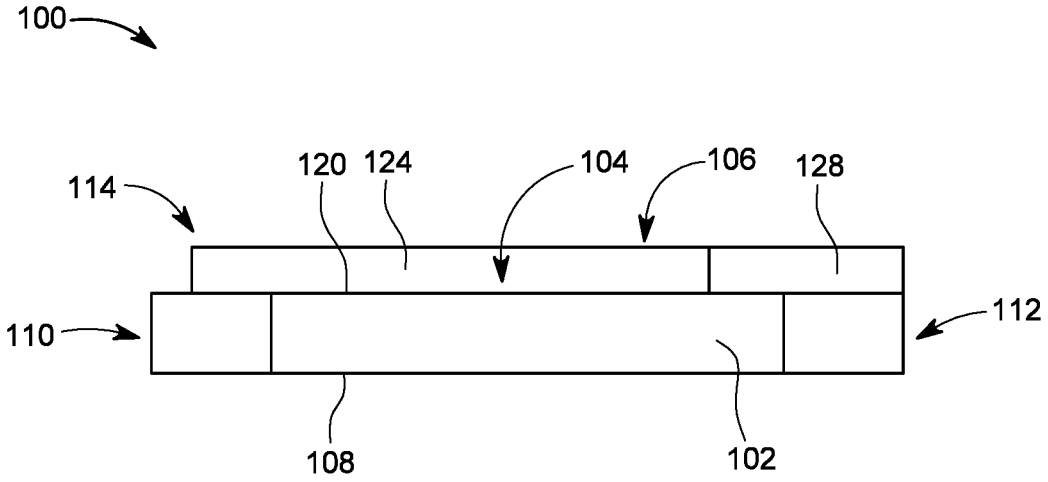
FIG. 2 is a cross-sectional view along the lateral line 2-2 of FIG. 1.

Referring now to FIG. 2, therein is shown a cross-sectional view along the lateral line 2-2 of FIG. 1. The thumb recess 120 is shown with the intermediate surface 104 exposed from the top surface 106.

The left side 110 of the body 102 does not have the top surface 106 extended thereover. The longitudinal ridge 128 is depicted extended up away from the thumb recess 120 along the right side 112.

Near the proximal end 114, the first lateral ridge 124 can be seen extended up away from the intermediate surface 104 and bordering the thumb recess 120. The bottom surface 108 of the body 102 can extend fully under the intermediate surface 104 from the left side 110 to the right side 112.

As will be appreciated, the ridges can be created with the top surface 106 extended away from the intermediate surface 104, while the bottom surface 108 does not include ridges. However, it has been discovered that the pick gripping system 100 can be effectively utilized by both right-handed or left-handed instrument players.

Figure 3:
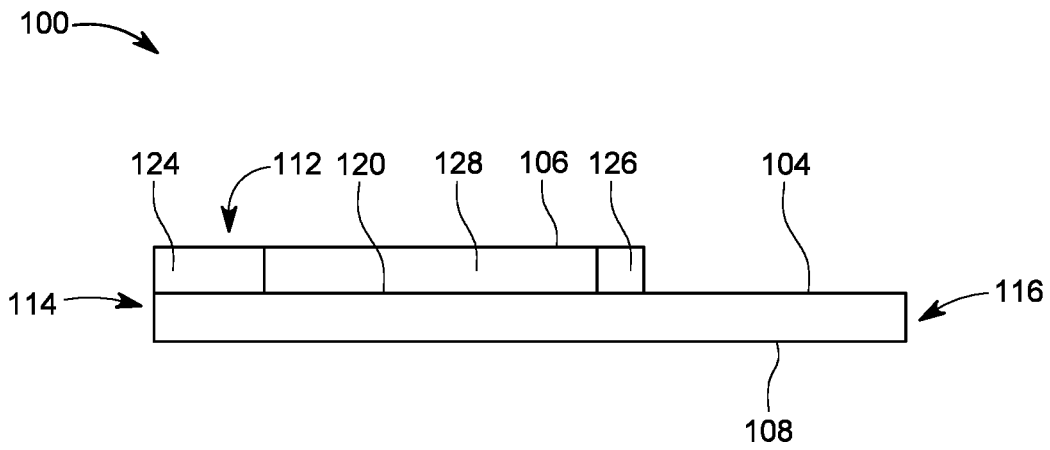
FIG. 3 is a cross-sectional view along the longitudinal line 3-3 of FIG. 1.

Referring now to FIG. 3, therein is shown a cross-sectional view along the longitudinal line 3-3 of FIG. 1. The thumb recess 120 is depicted surrounded by the first lateral ridge 124 near the proximal end 114, the second lateral ridge 126 extended between the thumb recess 120 and the distal end 116, and the longitudinal ridge 128 near the right side 112.

The bottom surface 108 is shown extended fully beneath the intermediate surface 104 from the proximal end 114 to the distal end 116. The distal end 116 can be fully exposed from the top surface 106 for providing a more supple and compliant pick.

Figure 4:
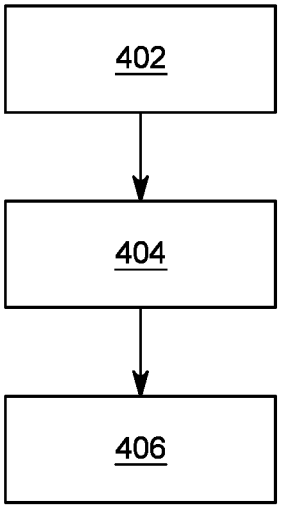
FIG. 4 is a method of manufacturing the pick gripping system of FIG. 1.

Referring now to FIG. 4, therein is shown a method of manufacturing the pick gripping system 100 of FIG. 1. The method of manufacture can include: forming a bottom surface on a body, the body having a left side, a right side, a proximal end, and a distal end in a block 402; forming an intermediate surface on the body in a block 404; and forming a top surface on the body, the top surface coupled to the intermediate surface with upward extending sides therebetween, the upward extending sides and the top surface forming a first lateral ridge extended from the left side of the body to the right side of the body, the upward extending sides and the top surface forming a second lateral ridge extended from the left side of the body to the right side of the body, and the first lateral ridge and the second lateral ridge forming a thumb recess therebetween in a block 406.

Thus, it has been discovered that the pick gripping system furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

While the pick gripping system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A pick gripping system comprising:

a bottom surface formed on a body, the body having a left side, a right side, a proximal end, and a distal end;

an intermediate surface formed on the body; and a top surface formed on the body, the top surface coupled to the intermediate surface with upward extending sides therebetween, the upward extending sides and the top surface forming a first lateral ridge extended from the left side of the body to the right side of the body, the upward extending sides and the top surface forming a second lateral ridge extended from the left side of the body to the right side of the body, and the first lateral ridge and the second lateral ridge forming a thumb recess therebetween.

2. The system of claim 1 wherein the second lateral ridge is formed between the thumb recess and the distal end of the body.

3. The system of claim 1 wherein the first lateral ridge is formed across the proximal end of the body.

4. The system of claim 1 wherein the top surface of the first lateral ridge extends from the thumb recess to the proximal end of the body.

5. The system of claim 1 wherein the intermediate surface is fully exposed from the top surface along the distal end of the body.

6. A pick gripping system comprising:

a bottom surface formed on a body, the body having a left side, a right side, a proximal end, and a distal end;

an intermediate surface formed on the body; and a top surface formed on the body, the top surface coupled to the intermediate surface with upward extending sides therebetween, the upward extending sides and the top surface forming a first lateral ridge extended from the left side of the body to the right side of the body, the upward extending sides and the top surface forming a second lateral ridge extended from the left side of the body to the right side of the body, the upward extending sides and the top surface forming a longitudinal ridge between the first lateral ridge and the second lateral ridge, and the first lateral ridge and the second lateral ridge forming a thumb recess therebetween.

7. The system of claim 6 wherein the intermediate surface is fully exposed from the top surface along the left side of the body.

8. The system of claim 6 wherein the upward extending sides are vertically extended away from the intermediate surface.

9. The system of claim 6 wherein the longitudinal ridge is formed on right side of the body.

10. The system of claim 6 wherein the longitudinal ridge is in direct physical contact with the first lateral ridge and the second lateral ridge.

11. A method of manufacturing a pick gripping system comprising:

forming a bottom surface on a body, the body having a left side, a right side, a proximal end, and a distal end;

forming an intermediate surface on the body; and forming a top surface on the body, the top surface coupled to the intermediate surface with upward extending sides therebetween, the upward extending sides and the top surface forming a first lateral ridge extended from the left side of the body to the right side of the body, the upward extending sides and the top surface forming a second lateral ridge extended from the left side of the body to the right side of the body, and the first lateral ridge and the second lateral ridge forming a thumb recess therebetween.

12. The method of claim 11 wherein forming the top surface includes forming the second lateral ridge between the thumb recess and the distal end of the body.

13. The method of claim 11 wherein forming the top surface includes forming the first lateral ridge across the proximal end of the body.

14. The method of claim 11 wherein forming the top surface includes forming the top surface of the first lateral ridge extended from the thumb recess to the proximal end of the body.

15. The method of claim 11 wherein forming the intermediate surface includes forming the intermediate surface fully exposed from the top surface along the distal end of the body.

16. The method of claim 11 wherein forming the top surface includes forming a longitudinal ridge between the first lateral ridge and the second lateral ridge.

17. The method of claim 16 wherein forming the intermediate surface includes forming the intermediate surface fully exposed from the top surface along the left side of the body.

18. The method of claim 16 wherein forming the top surface, the intermediate surface, or a combination thereof includes forming the upward extending sides vertically extended away from the intermediate surface.

19. The method of claim 16 wherein forming the top surface includes forming the longitudinal ridge on right side of the body.

20. The method of claim 16 wherein forming the top surface includes forming the longitudinal ridge is in direct physical contact with the first lateral ridge and the second lateral ridge.

* * * * *